US011236968B2

(12) United States Patent
Jacobson

(10) Patent No.: US 11,236,968 B2
(45) Date of Patent: Feb. 1, 2022

(54) FIREARM MAINTENANCE TOOL

(71) Applicant: New Revo Brand Group, LLC, Plymouth, MN (US)

(72) Inventor: Ryan Jacobson, Minneapolis, MN (US)

(73) Assignee: New Revo Brand Group, LLC, Plymouth, MN (US)

( * ) Notice: Subject to any disclaimer, the term of this patent is extended or adjusted under 35 U.S.C. 154(b) by 213 days.

(21) Appl. No.: 16/695,899

(22) Filed: Nov. 26, 2019

(65) Prior Publication Data

US 2021/0156643 A1 May 27, 2021

(51) Int. Cl.

| | |
|---|---|
| ***F41C 27/00*** | (2006.01) |
| ***B25F 1/04*** | (2006.01) |
| *F41A 29/00* | (2006.01) |

(52) U.S. Cl.
CPC ..... *F41C 27/00* (2013.01); *B25F 1/04* (2013.01); *F41A 29/00* (2013.01)

(58) Field of Classification Search
CPC ..... F41C 27/00; B25F 1/04
See application file for complete search history.

(56) References Cited

U.S. PATENT DOCUMENTS 6,223,372 B1 * 5/2001 Barber ..... B25F 1/00 7/118
2009/0056088 A1 3/2009 Petzl et al.

OTHER PUBLICATIONS

"Wheeler Carbon Multi-Scraper" Retrieved from https://www.wheelertools.com/wheeler-carbon-multi-scraper/1078195.html. Retrieved on Feb. 20, 2020.
"AR15 Scraper" Retrieved from https://www.realavid.com/shop/the-ar15-scraper-1. Retrieved on Feb. 20, 2020.
"AR15 Front Sight Adjuster Tool" Retrieved from https://www.realavid.com/shop/ar15-front-sight-adjuster-tool Retrieved on Feb. 20, 2020.

* cited by examiner

*Primary Examiner* — J. Woodrow Eldred
(74) *Attorney, Agent, or Firm* — Grumbles Law PLLC

(57) ABSTRACT

A firearm maintenance tool can include a rigid body and a locking gate. The rigid body can include a spine, a foot, and a hooked head having a receiving cavity, wherein the rigid body is structured and configured to optionally house a plurality of pivotally connected tools. The locking gate can include a pivoting receiver at a first end of the locking gate that is pivotally connected to the rigid body, a removable connection piece at a second end of the locking gate, and a threaded shaft located at least partially within the pivoting receiver. The removable connection piece can have a threaded connection with threaded shaft and can at least partially insert into hooked head to lock the locking gate to the rigid body and create an enclosure for a strap.

20 Claims, 5 Drawing Sheets

FIREARM MAINTENANCE TOOL

FIELD OF THE INVENTION

This disclosure relates to firearm maintenance aids, and more particularly, relates to a multi-tool for firearm maintenance.

BACKGROUND OF THE INVENTION

During maintenance activities, firearms such as rifles (or sub-components thereof) are often opened and disassembled. This enables an armorer to more thoroughly perform maintenance tasks and can help the armorer gain access to hard-to-reach pieces and components. Multi-tools that assist with disassembly and cleaning are known in the field. However, due to their compact size, they can easily be misplaced or lost. It would be desirable to provide a multi-tool that can facilitate disassembly, cleaning, and maintenance of a firearm and that can decrease the probability of being misplaced or lost.

SUMMARY OF THE INVENTION

This disclosure relates to firearm maintenance aids, and more particularly, relates to multi-tools for firearm maintenance. In an illustrative but non-limiting example, the disclosure provides a firearm maintenance tool that can include a rigid body and a locking gate. The rigid body can house and protect a plurality of tools within its walls and its other components. The locking gate can be pivotally connected on a first end to the rigid body and configured to be releasably secured to the rigid body on a second end. The locking gate can be comprised of a pivoting receiver at the first end of the locking gate and a removable connection piece at the second end of the locking gate.

In some examples, the locking gate can be further comprised of a threaded shaft that can be secured at least partially within the pivoting receiver. Further, the removable connection piece can be hollow, can be structured and configured to surround the threaded shaft, and can secure a first end within the pivoting receiver. For example, an outside, threaded portion of the threaded shaft can have a threaded connection with an inside surface of the removable connection piece to enable the removable connection piece to be secured inside the pivoting receiver (for example, by twisting the threaded removable connection piece onto the threaded shaft). Additionally, a second end of the removable connection piece may be structured and configured to fit within a receiving cavity of the rigid body thereby releasably securing the locking gate to the rigid body and creating an enclosure. In some cases, the rigid body can include a spine, a foot at a first end of the spine, and a hooked head at a second end of the spine, wherein the receiving cavity can be at one end of the hooked head. The enclosure may then be defined by a space between the foot, the spine, the hooked head, and the locking gate.

In some examples, the threaded shaft can be a takedown punch for removing firearm pins. And in other examples, the removable connection piece can be a front sight adjuster having prongs for maintenance of a front sight of a firearm. In additional examples, the removable connection piece can be structured and configured for manual, tool-free removal from the locking gate.

In some examples, the removable connection piece can include a body, a head, and a cap that are substantially colinear. The body of the removable connection piece can connect with the pivoting receiver, the cap of the removable connection piece can be structured and configured to be secured within a receiving cavity of the rigid body, and the head of the removable connection piece can be sized to prevent the removable connection piece from inserting into the receiving cavity past the cap.

In some examples, the various firearm maintenance tools can be contained by the rigid body and at least one of the plurality of tools can be pivotally connected on a first end to the rigid body. Further, at least one of the plurality of tools can include a flat, elongated tool having an aperture through its core that enables a user to grasp the aperture and swivel the flat, elongated tool from a stored position to an activated position extending away from the rigid body. Further, the rigid body can include a spine, a foot at a first end of the spine, and a hooked head at a second end of the spine, wherein each of the plurality of tools can be pivotally connected to one of the foot or the hooked head. In some cases, the hooked head can include a receiving cavity and an end of the removable connection piece can be structured and configured to fit within the receiving cavity, thereby releasably securing the locking gate to the rigid body.

In another illustrative but non-limiting example, the disclosure provides a firearm maintenance tool that can include a rigid body, a locking gate, and a plurality of tools contained by the rigid body. The rigid body can have a spine, a foot at a first end of the spine, and a hooked head at a second end of the spine. The locking gate can be pivotally connected on a first end to the foot and configured to be releasably secured to the hooked head on a second end. The locking gate can include a pivoting receiver at the first end of the locking gate, a threaded shaft located at least partially within the pivoting receiver, and a removable connection piece at the second end of the locking gate. In some cases, an outside portion of the threaded shaft can have a threaded connection with an inside surface of the removable connection piece to enable the removable connection piece to be secured inside the pivoting receiver. In some cases, a cap of the removable connection piece can be structured and configured to be secured within a receiving cavity of the hooked head, and a head of the removable connection piece can be substantially colinear with the cap and structured and configured to prevent the removable connection piece from inserting into the receiving cavity past the cap.

In another illustrative but non-limiting example, the disclosure provides a method for releasably locking a locking gate to a rigid body, the method including the steps of rotating a pivoting receiver of a locking gate away from a rigid body, placing an internally threaded removable connection piece of the locking gate around an externally threaded shaft that is located at least partially within the pivoting receiver, twisting the removable connection piece in a first direction to create a threaded connection between the removable connection piece and the threaded shaft, rotating the pivoting receiver toward the rigid body so that the removable connection piece is substantially colinear with a receiving cavity of the rigid body, and twisting the removable connection piece in a second, opposite direction to move the removable connection piece toward the receiving cavity. In some cases, a cap of the removable connection piece can insert into the receiving cavity, and further movement into the receiving cavity can be prevented by a head of the removable connection piece that is substantially colinear with the cap.

The above summary is not intended to describe each and every example or every implementation of the disclosure.

The description that follows more particularly exemplifies various illustrative embodiments.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which.

DETAILED DESCRIPTION

Figure 1:
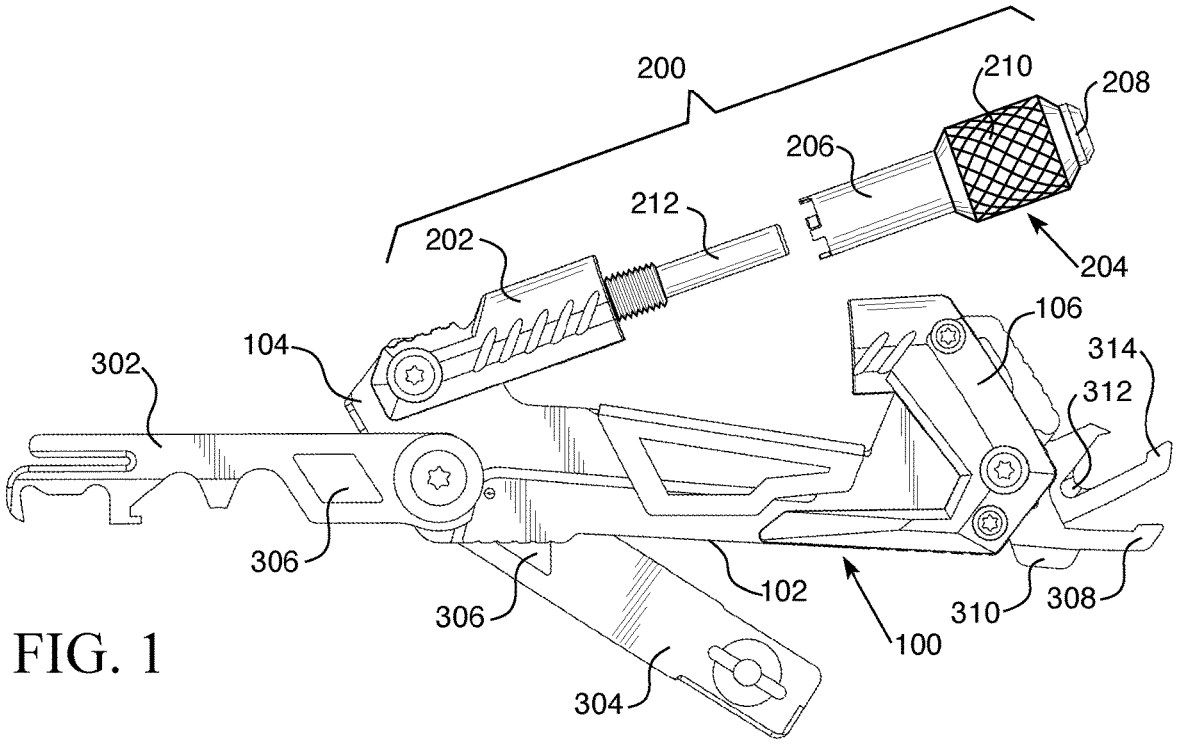
FIG. 1 is a front elevational view of an illustrative example of a firearm maintenance tool of the present disclosure in an unlocked state and with various tools in activated configurations.

The present disclosure relates to firearm maintenance aids, and more particularly, relates to a multi-tool for firearm maintenance. Various embodiments are described in detail with reference to the drawings, in which like reference numerals may be used to represent like parts and assemblies throughout the several views. Reference to various embodiments does not limit the scope of the systems and methods disclosed herein. Examples of construction, dimensions, and materials may be illustrated for the various elements, those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

Figure 3:
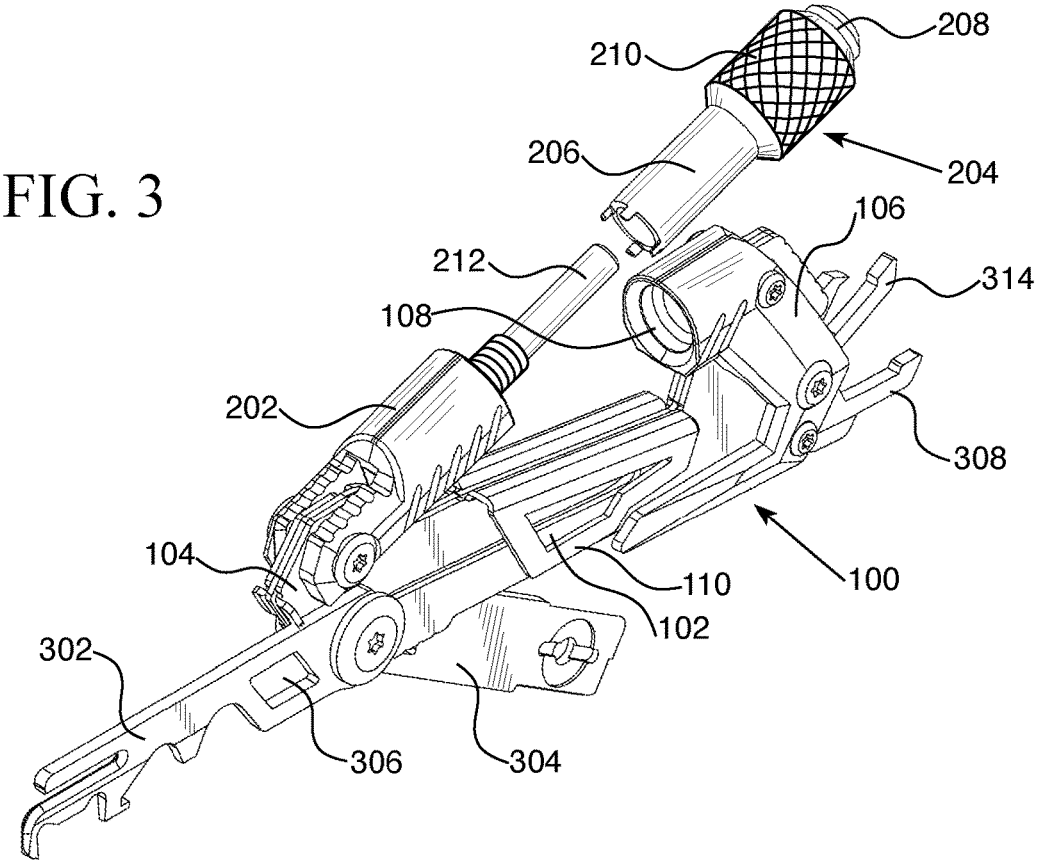
FIG. 3 is a perspective front view of the firearm maintenance tool in an unlocked state with various tools in activated configurations.
Figure 4:
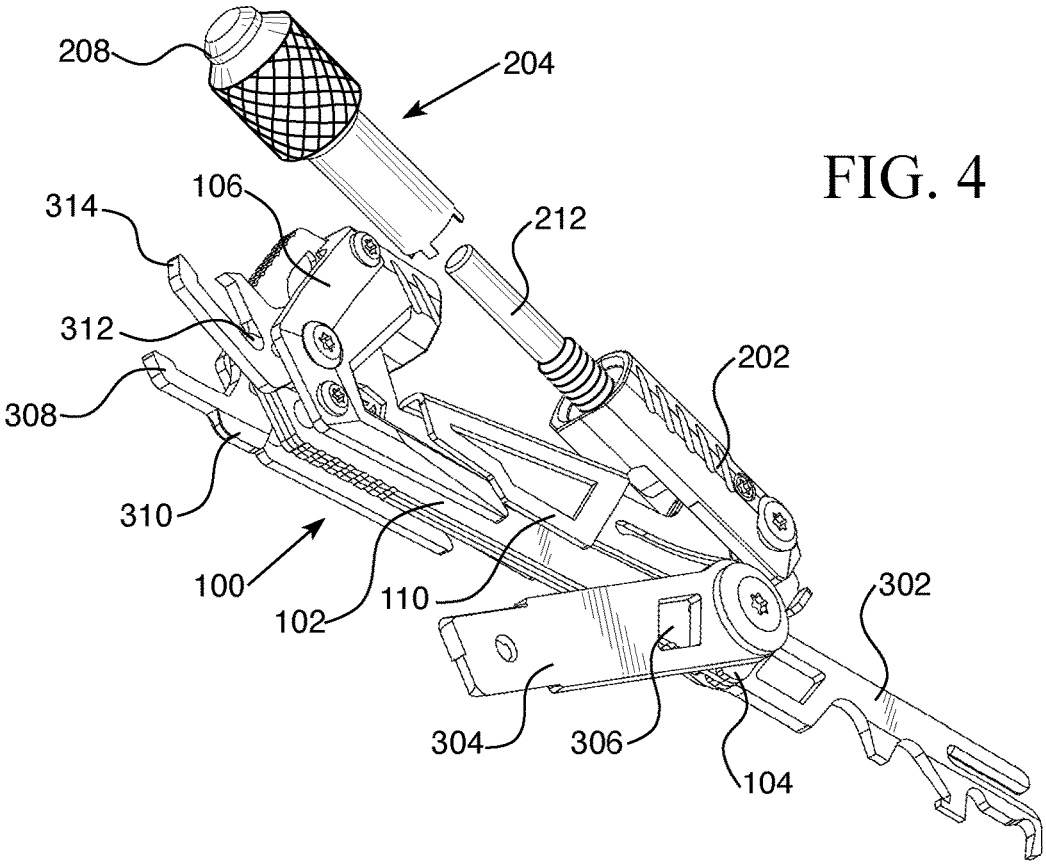
FIG. 4 is a perspective back view of the firearm maintenance tool in an unlocked state with various tools in activated configurations.
Figure 5:
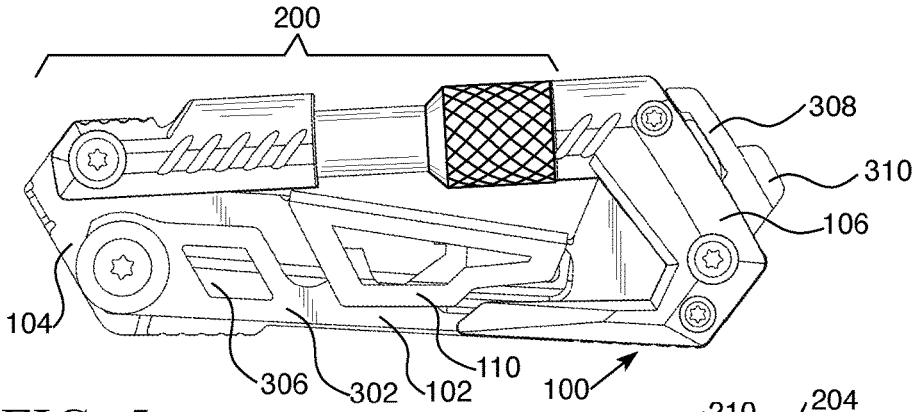
FIG. 5 is a front elevational view of the firearm maintenance tool in a locked state with various tools in closed configurations.

FIG. 1 is a front view of an illustrative example of a firearm maintenance tool in an unlocked state and with various tools in activated configurations. Firearm maintenance tool includes rigid body 100 and locking gate 200. Rigid body 100 can be a compact base on which locking gate 200 connects and locks, as illustrated in FIGS. 1 and 5. Locking gate 200 can pivotally connect on a first end to rigid body 100, as illustrated in FIGS. 1-4, and locking gate can be releasably secured (or locked) to rigid body on a second end, as further illustrated in FIGS. 5-8. Further, an enclosure can exist that is defined by a space between rigid body 100 and locking gate 200. In some embodiments, a plurality of tools can connect to, and be contained by, rigid body 100, but this is not necessary, and it is envisioned that embodiments exist without these tools.

Figure 2:
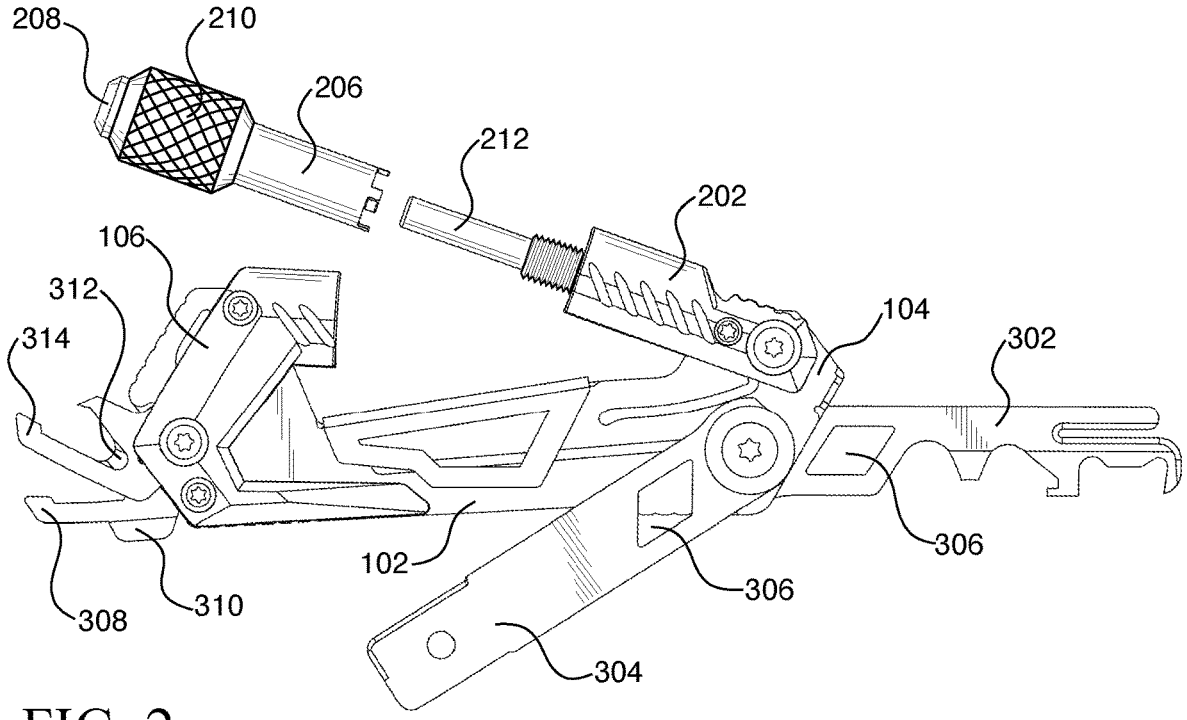
FIG. 2 is a back elevational view of the firearm maintenance tool in an unlocked state and with various tools in activated configurations.
Figure 6:
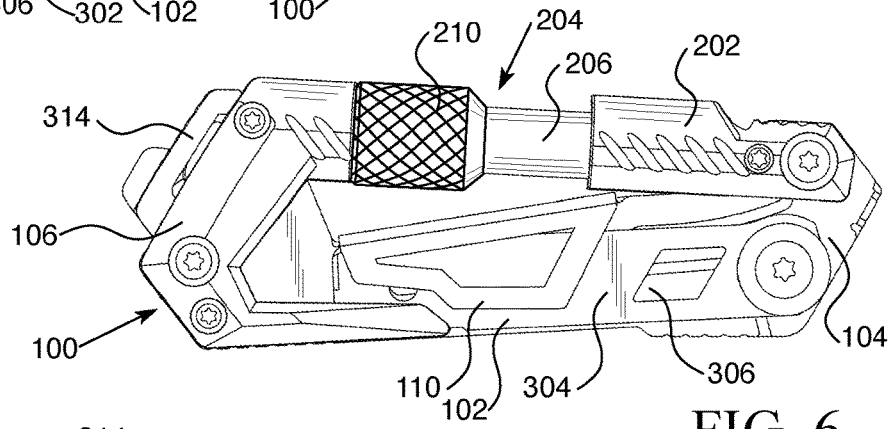
FIG. 6 is a back elevational view of the firearm maintenance tool in a locked state with various tools in closed configurations.
Figure 7:
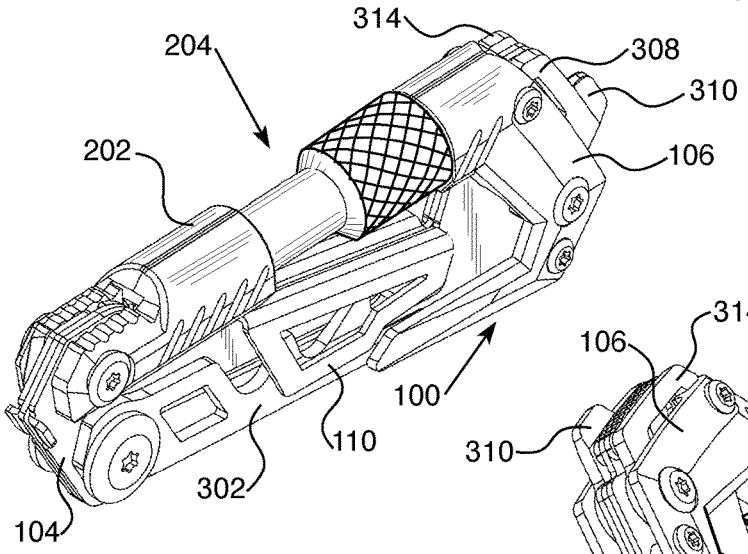
FIG. 7 is a perspective front view of the firearm maintenance tool in a locked state with various tools in closed configurations.
Figure 8:
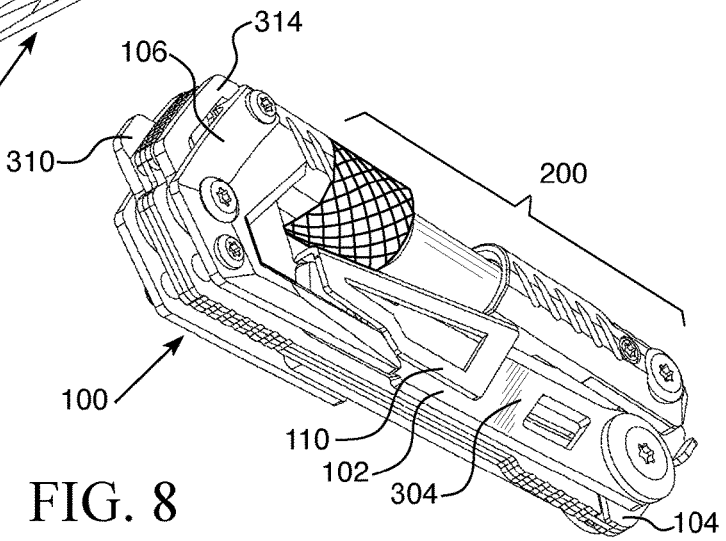
FIG. 8 is a perspective back view of the firearm maintenance tool in a locked state with various tools in closed configurations.
Figure 9A:
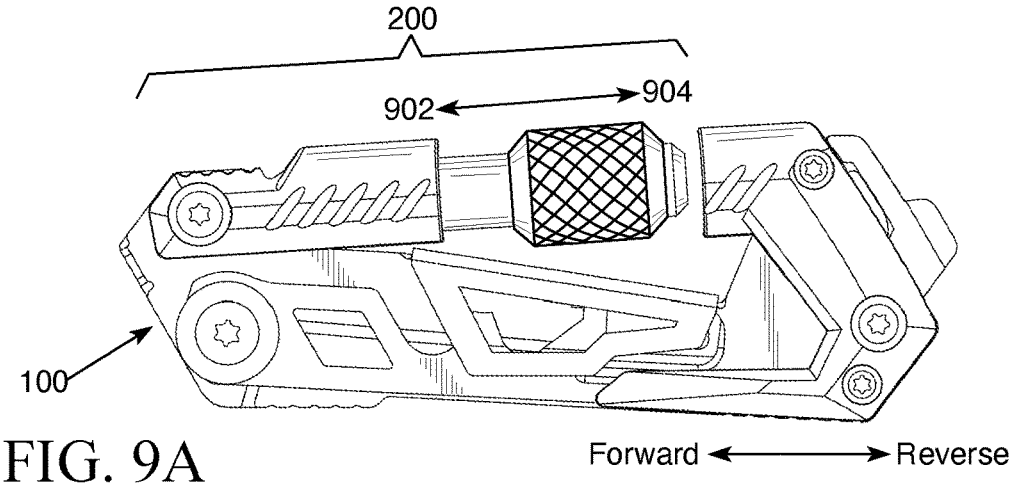
FIGS. 9A, 9B and 9C illustrate front views of the firearm maintenance tool transitioning between the pivoting and unlocking states.
Figure 9B:
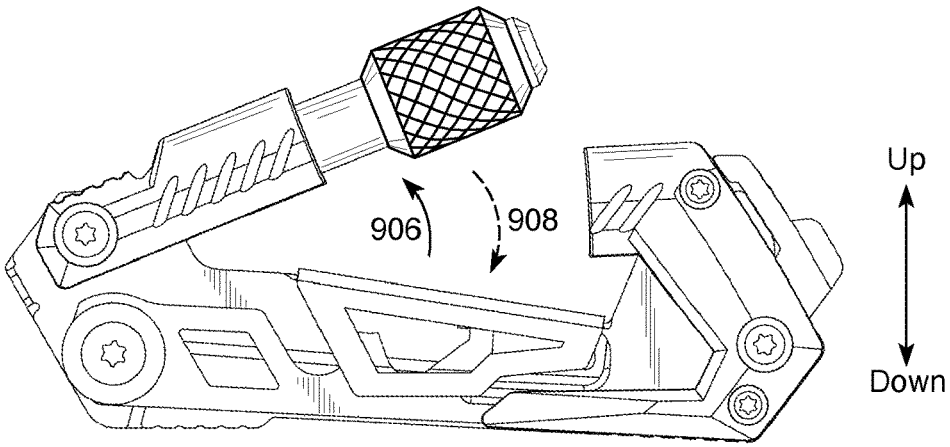
Figure 9C:
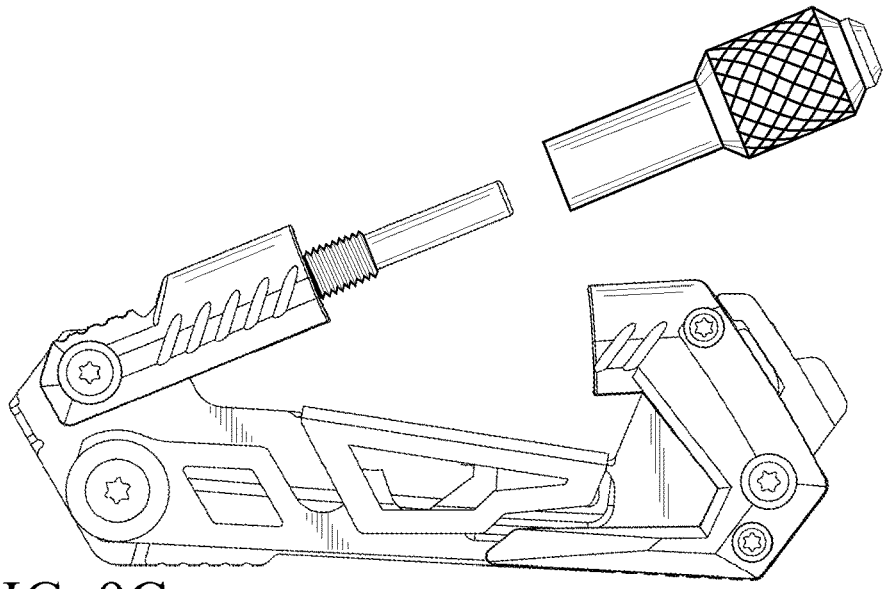
Figure 10A:
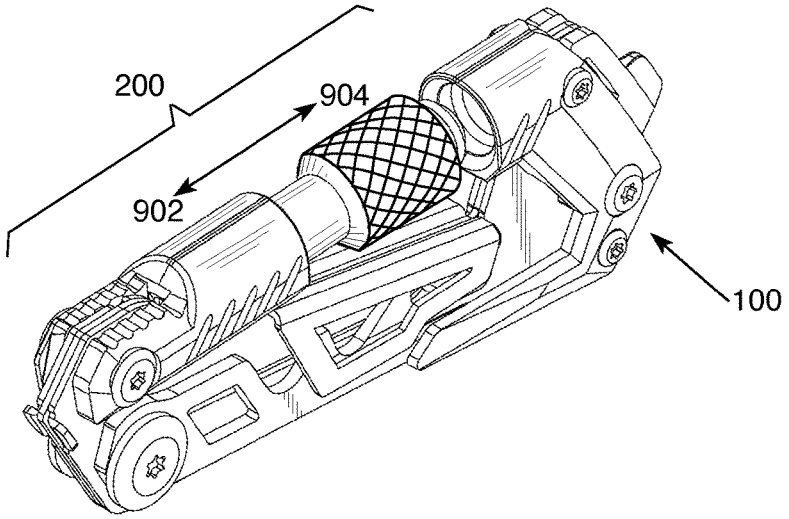
FIGS. 10A, 10B and 10C illustrate perspective front views of the firearm maintenance tool transitioning between the pivoting and unlocking states.
Figure 10B:
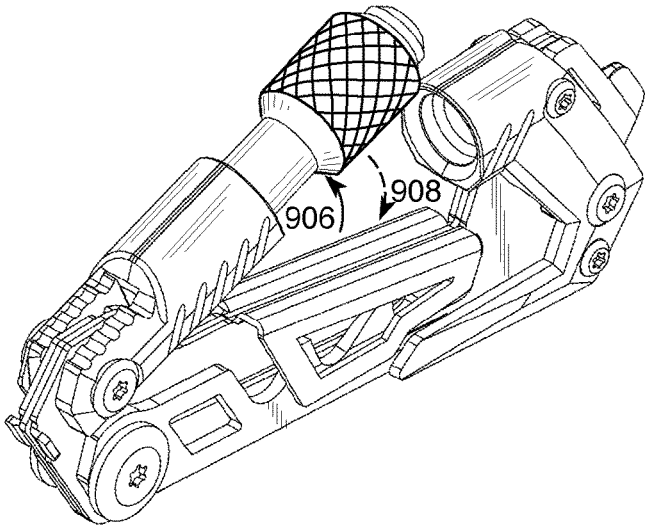
Figure 10C:
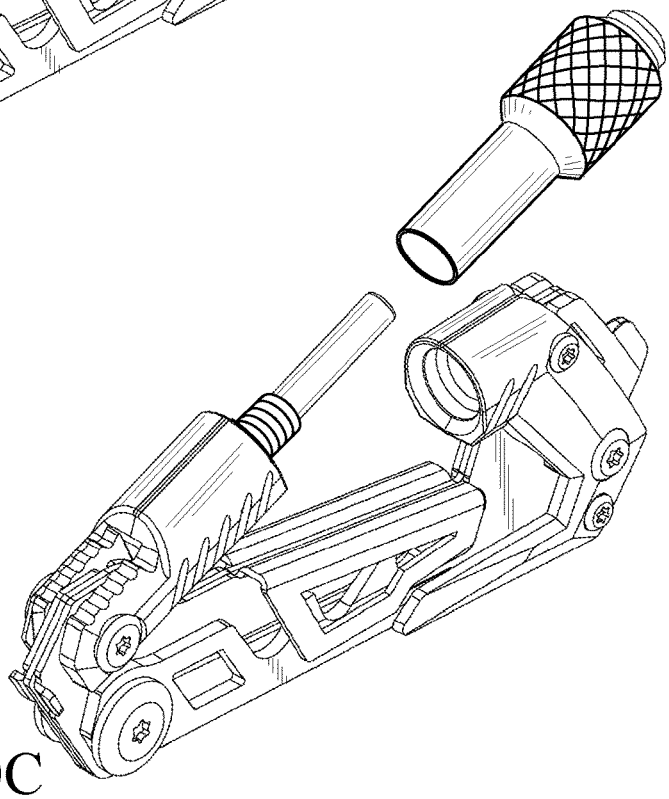

Additional views of firearm maintenance tool are provided. FIG. 2 is a back view of firearm maintenance tool. FIG. 3 is a perspective front view of firearm maintenance tool. FIG. 4 is a perspective back view of the firearm maintenance tool. FIG. 5 is a front elevational view of the firearm maintenance tool in a locked state with various tools in closed configurations. FIG. 6 is a back elevational view of the firearm maintenance tool. FIG. 7 is a perspective front view of the firearm maintenance tool. FIG. 8 is a perspective back view of the firearm maintenance tool. FIGS. 9A, 9B and 9C illustrate front views of the firearm maintenance tool transitioning between the pivoting and unlocking states. FIGS. 10A, 10B and 10C illustrate perspective front views of the firearm maintenance tool transitioning between the pivoting and unlocking states.

Rigid body 100 can be comprised of rigid materials such that rigid body 100 cannot be folded, bent, or otherwise forced out of shape. Examples of materials used for rigid body 100 include, but are not limited to, metal (for example, aluminum, steel, iron, brass, copper, etc.), plastic (for example, high-density polyethylene, polyvinyl chloride, polypropylene, other thermoplastic polymers, etc.), high durometer rubber, and combinations thereof. The shape of rigid body 100 can be such that it has elongate spine 102 with foot 104 at one end of the spine and head 106 at a second end of the spine.

Head 106, in some embodiments, can be hooked such that a first end of the hook is at the second end of spine 102 and a second end of the hook is at a distance from spine that creates a gap between the first end of the hook and the second end of the hook. This second end of the hook can have receiving cavity 108. Receiving cavity 108 can be structured and configured to receive a portion of locking gate 200 for purposes of removably locking rigid body and locking gate together, as described further below. More specifically, receiving cavity 108 may be located at an end of hooked head 106 such that the end of hooked head appears hollow in nature, as illustrated in FIG. 3. This hollow area can be structured and configured to allow a portion of locking gate 200 to insert within receiving cavity 108. In this regard, the connection between receiving cavity 108 and locking gate 200 reflects a, respectively, female and male connection system.

In addition to rigid body 100, the firearm maintenance tool can include locking gate 200. Locking gate 200 can pivotally connect on a first end to rigid body 100, as illustrated in FIGS. 1-4, and locking gate 200 can be releasably secured (or locked) to rigid body 100 on a second end. More specifically, locking gate 200 can connect on a first end and at a pivot point to foot 104 and can be releasably secured to hooked head 106 on a second end, as illustrated in FIGS. 5-8. Further, an enclosure can exist that is defined by a space between rigid body 100 and locking gate 200 when locking gate is secured to rigid body. More specifically, the enclosure is defined by the space between the combined foot 104, spine 102, and hooked head 106 of rigid body 100 and locking gate 200.

Therefore, the firearm maintenance tool described herein can operate similar to a carabiner such that straps, ropes, cables, loops, or any other elongated material (hereinafter this type of object is referred to as "strap") can be placed in the enclosure of the firearm maintenance tool when locking gate 200 is open. Locking gate 200 can then be closed and locked to rigid body 100, thereby securing the strap within the enclosure of the firearm maintenance tool. In this manner, the firearm maintenance tool can be secured to, for example, a belt loop, belt, backpack strap, lanyard, MOLLE (modular lightweight load-carrying equipment), PALS (pouch attachment ladder system), bag strap, fabric handle, or any other piece of equipment having a strap secured on two ends to create a loop.

Locking gate 200 can include at least pivoting receiver 202 and removable connection piece 204. In some cases, locking gate 200 can also include threaded shaft 212. Pivoting receiver 202 can be located at the first, pivotally connected, end of locking gate 200, which may be at foot 104 of rigid body 100. Removable connection piece 204 can be located at the second end of locking gate 200 and may securely connect with receiving cavity 108 of hooked head 106 of rigid body 100. In some embodiments, removable connection piece 204 is removably connected to pivoting receiver 202 of locking gate 200 by being secured around threaded shaft 212, which can be located at least partially within pivoting receiver 202. More specifically, removable connection piece 204 can be structured and configured for manual, tool-free removal from locking gate 200. Examples of how removable connection piece 204 is removably connected to locking gate 200 are provided below.

Pivoting receiver 202 can be partially or primarily hollow and may be rigid in form. In some cases, an interior of pivoting receiver 202, exterior of pivoting receiver 202, or combination thereof is cylindrical. For example, an exterior of pivoting receiver 202 may have flat surfaces while an interior of pivoting receiver may be cylindrical. In another example, both the interior and exterior of pivoting receiver 202 are cylindrical. In yet another example, the interior of pivoting receiver 202 is cylindrical, and the exterior is partially cylindrical and partially flat. More specifically, as illustrated in FIG. 4, the upper and side surfaces of the exterior of pivoting receiver 202 can be curved while the lower surface can be flat so as to align with the opposing, flat surface of rigid body 100. While pivoting receiver 202 may be rigid, it can be connected at a pivot point to foot 104 so that it is not fixed in place but is rotatable around its connected end.

Removable connection piece 204 can be a rigid, elongated structure that, as mentioned above, connects between pivoting receiver 202 and receiving cavity 108, as illustrated in FIGS. 10A-10C. In some embodiments, removable connection piece 204 can be comprised at least of body 206 and cap 208. In some cases, removable connection piece 204 can also include head 210. Similar to pivoting receiver 202, removable connection piece 204 can be partially or primarily hollow. Further, removable connection piece 204 may be a front sight adjuster having prongs for maintenance of a front sight of a firearm.

Body 206 of removable connection piece 204 may be cylindrical in shape, as illustrated in the figures, and can have a smaller radius than pivoting receiver 202 so that at least a portion of removable connection piece 204 can fit within pivoting receiver 202. In some cases, body 206 may be threaded to enable it to make a threaded connection with pivoting receiver 202 such that when body 206 is inserted into pivoting receiver 202 and is twisted in a first, forward direction, as illustrated by arrow 902 in FIGS. 9A and 10A, removable connection piece 204 and pivoting receiver 202 are physically engaged via their threaded components. This, in effect, can shorten the combined length of pivoting receiver 202 and connection piece 204 compared to when connection piece 204 is first inserted before being twisted. In some cases, body 206 can be externally threaded. In other cases, body 206 can be internally threaded (not illustrated).

As mentioned above, removable connection piece 204 may be a front sight adjuster having prongs, as illustrated in FIGS. 1-4. Prongs may be located at a distal end of body 206 away from proximal end, which is closest to cap 208, may have a square or rectangular shape, and may project outward from and substantially colinear with body 206. The number of prongs can vary. For example, removable connection piece 204 may have two, three, four, or more prongs spaced evenly or unevenly around the distal end of body 206.

Cap 208 may be disc-shaped (i.e., circular with a short height) such that its height is less than its radius, or it may be cylindrical such that its height is equal to or greater than its radius. Cap 208 can have a smaller radius than receiving cavity 108 so that cap 208 can be secured within receiving cavity of hooked head 106. Further, cap 208 may be beveled near its tip to help guide cap 208 into receiving cavity 108. Therefore, removable connection piece 204 can fit within pivoting receiver 202, be twisted in the first, forward direction, indicated by arrow 902 in FIGS. 9A and 10A, to make a threaded connection and create a clearance for removable connection piece 204 to rotate past an outer edge of hooked head 106, indicated by dashed arrow 908 in FIGS. 9B and 10B, and then be twisted in a second, reverse direction, indicated by arrow 904 in FIGS. 9A and 10A, once cap 208 and receiving cavity 108 are aligned and substantially colinear so that cap 208 can fit within receiving cavity 108 and lock locking gate 200 in place on rigid body 100. When the second end of removable connection piece 204 (i.e., cap 208) is releasably secured within receiving cavity 108, rigid body 100 and locking gate 200 create the enclosure described above.

In some embodiments, removable connection piece 204 can also include head 210. Head 210 may be located between body 206 and cap 208, as illustrated in FIGS. 1-4, such that body 206, head 210, and cap 208 are substantially colinear. In some cases, head 210 may have a larger radius than body 206, cap 208, receiving cavity 108, or any combination thereof. In this manner, when locking gate 200 is aligned with receiving cavity 108, head 210 may be sized and/or shaped to help prevent removable connection piece 204 from inserting into receiving cavity 108 past cap 208. Head 210 may also help prevent removable connection piece 204 from separating from pivoting receiver 202 when it is rotated in reverse, indicated by arrow 904. More specifically, after body 206 has a threaded connection with pivoting receiver 202, the combined pivoting receiver 202 and removable connection piece 204 can be rotated downward toward hooked head 106, illustrated by dashed arrow 908 in FIGS. 9B and 10B, so that cap 208 is substantially colinear with receiving cavity 108. Then, when body 206 is twisted in the second, reverse direction 904, cap 208 can move toward, and into, receiving cavity 108 until head 210 makes contact with an outer edge of receiving cavity 108. If head 210 has a larger radius than receiving cavity 108, its contact with receiving cavity 108 can prevent continued movement of removable connection piece 204 in the second, reverse direction 904 and can also prevent removable connection piece 204 from continuing to rotate in the reverse direction 904 so that removable connection piece 204 retains a threaded connection with pivoting receiver 202. Head 210 may have a textured or knurled surface, such that it has a series of ridges or projections that can provide a user with a better gripping surface for twisting removable connection piece 204 with user's fingers in and out of pivoting receiver 202.

In some embodiments, locking gate 200 may be further comprised of threaded shaft 212. Threaded shaft 212 may be located at least partially within pivoting receiver 202. In examples described above where removable connection piece 204 (and, specifically, body 206) has a threaded connection with pivoting receiver 202, the portion of pivoting receiver 202 having a threaded connection with removable connection piece 204 may be threaded shaft 212. More specifically, an external surface of threaded shaft 212 may be threaded, and an internal surface of body 206 of removable connection piece 204 may be threaded such that removable connection piece 204 can slide into pivoting receiver 202 and over threaded shaft and then twist in the first, forward direction 902 onto threaded shaft 212 to create a threaded connection between removable connection piece 204 and threaded shaft 212.

In some embodiments, threaded shaft 212 may be a takedown punch that can be used to remove firearm pins. Therefore, the first end of threaded shaft 212, closest to hooked head 106, may have an elongated, smooth surface to be used for punching out firearm pins. The second end of threaded shaft 212, closest to foot 104, may be the threaded end that engages with the internally threaded surface of removable connection piece 204. In some embodiments, the threaded end may be threaded from the tip of threaded shaft 212 to where it transitions to elongated smooth, surface. In other embodiments, threaded shaft 212 may have threaded end located between two smooth surfaces. More specifically, threaded shaft 212 may be smooth at its second end where it attaches to pivoting receiver 202 near foot 104, may transition to a threaded portion, and may then transition back to an elongated, smooth surface along the first end, closest to hooked head 106.

In addition to embodiments where removable connection piece 204 is a front sight adjustor and embodiments where threaded shaft 212 is a takedown punch, rigid body 100 can include a plurality of other tools for maintaining and cleaning a firearm. One or more of these tools can be pivotally connected on a first end to rigid body 100, such that from a closed configuration the tool can pivot outward and away from the rigid body along an x and y axis to an open configuration. Therefore, in a closed configuration, the tools may not protrude out from rigid body 100 but can instead be aligned alongside or inside of rigid body, as illustrated in FIGS. 5-8. This allows for a compact multi-tool that is easily transportable.

In an open configuration, one or more tools may be pivoted outward, as illustrated in FIGS. 1-4, and rigid body 100 can be used as a handle or grip for grasping by the user's hand. In some cases, each of the tools can be pivotally connected to one of foot 104 or hooked head 106 of rigid body 100. However, some of the tools may be otherwise connected (for example, they may be embedded between layers of rigid body 100 and may slide out of a gap in the side of the rigid body), and some of the tools may pivot from other regions of rigid body, such as elongated spine 102.

Examples of various tools include flat, elongated tools such as, but not limited to, bolt and firing pin scraper 302 and bolt carrier and firing pin scraper 304. To more easily rotate the flat, elongated tools from their closed configurations to their open configurations, the flat, elongated tools may include a gap or aperture in their core, such as scraper aperture 306 illustrated in FIGS. 1-4, that enables a user to grasp aperture 306 and swivel corresponding scrapers 302, 304 outward from a stored position to an activated position extending away from rigid body 100. This aperture may be particularly beneficial if, as illustrated in FIGS. 5-8, scrapers 302, 304 tuck into cage 110 on rigid body 100 when they are in their closed configurations, cage 110 thereby at least partially encasing the scrapers and making them otherwise difficult to grasp when trying to rotate them outward away from rigid body.

More specifically, cage 110 may be centrally located on spine 102, may be open at its bottom, and may leave a gap between outer surface of spine 102 and inner surface of side of cage 110. This space can be wider than the thickness of a flat, elongated tool so that when flat, elongated tool rotates from an activated to a closed configuration, it can slide upward through the bottom of cage 110 and may fit within the gap, as illustrated in FIGS. 5-10. In some embodiments cage 110 may cover the distal end of flat, elongated tools such that the tips of flat, elongated tools are hidden within cage 110 and not reachable by a user's fingers or damageable by unwanted contact with other tools or objects. Cage 110 can also be long enough to cover any other tool surfaces of flat, elongated tools, such as those illustrated on scrapers 302, 304 in FIGS. 1-4.

Additional examples of various tools include bolt override 308, scope turret adjuster 310, cord cutter 312, and bottle opener 314. Combinations of these tools may be shared on a single rotatable tool piece such that they are not separately rotatable. For example, bolt override 308 and scope turret adjuster 310 can be located on the same tool piece, as illustrated in FIGS. 1 and 3. Bolt override 308 may be located near a tip of the tool piece, and scope turret adjuster 310 may be located along a bottom edge of the same tool piece. In another example, cord cutter 312 and bottle opener 314 can be located on the same tool piece, as illustrated in FIGS. 2 and 4. The tool piece may be roughly u-shaped to enable cord cutter 312 to be located on an interior lower curvature of the u-shaped piece, and bottle opener 314 may be formed from the upper points of the u-shaped piece. The upper points may have hooked or sharpened edges to enable easier use of bottle opener 314.

While the above-referenced tools have been described specifically, rigid body 100 of the firearm maintenance tool may include any combination of these tools or none at all. It may also include other tools that have not been disclosed herein.

As described above, firearm maintenance tool can be easily transported due to its compact size and ability to attach to various straps. In cases where removable connection piece 204 is a front sight adjuster, a user may wish to remove the front size adjuster, use it to adjust the front sight of a firearm, replace the front sight adjuster, and lock locking gate 200 back to rigid body 100.

Therefore, if the tool is in a closed and locked configuration, a user can unlock the tool by twisting removable connection piece 204 in a first, forward direction, as illustrated by left-pointing arrow 902 in FIGS. 9A and 10A, until cap 208 is completely separated from receiving cavity 108 and locking gate 200 is able to rotate without restriction. The user can then rotate locking gate 200 upward, as illustrated by solid arrow 906 in FIGS. 9B and 10B, until removable connection piece 204 has clearance from hooked head of rigid body 100. The user can then twist removable connection piece 204 in a second, reverse direction, as illustrated by right-pointing arrow 904 in FIGS. 9A and 10A, until removable connection piece and pivoting receiver 202 and/or threaded shaft 212 are no longer threadedly connected, at which time removable connection piece can be separated from firearm maintenance tool, as illustrated in FIGS. 9C and 10C. Once removed, removable connection piece 204 (ex., front sight adjuster) can be used as needed on a firearm.

When a user is ready to reconnect removable connection piece 204 to firearm maintenance tool and lock locking gate 200 to rigid body 100, user can, if needed, rotate pivoting receiver 202 of locking gate upward 906 and away from rigid body to put it into the position illustrated in FIGS. 9C and 10C, place internally threaded, removable connection piece 204 of locking gate around threaded shaft 212, which is located at least partially within pivoting receiver 202 and has external threading, twist removable connection piece 204 in a first, forward direction 902 to create a threaded connection between removable connection piece 204 and threaded shaft 212, rotate locking gate 200 downward toward rigid body 100, as indicated by dashed arrow 908 in FIGS. 9B and 10B, so that removable connection piece is substantially colinear with receiving cavity 108 of rigid body, as illustrated in FIGS. 9A and 10A, and twist removable connection piece 204 in a second, reverse (i.e., opposite) direction 904 to move removable connection piece 204 toward receiving cavity 108 such that cap 208 of removable connection piece 204 inserts into receiving cavity 108 and further movement into receiving cavity is prevented by head 210 of removable connection piece 204, as illustrated in FIGS. 5-8, head 210 being configured in line with cap 208.

Therefore, removable connection piece 204 can slide into pivoting receiver 202, over threaded shaft 212, if present, be twisted in the forward direction 902 to make a threaded connection and create a clearance for locking gate 200 to rotate down past hooked head 106, and then be twisted in a reverse direction 904 once cap 208 and receiving cavity 108 are substantially colinear so that cap 208 can fit within receiving cavity 108 and lock locking gate 200 in place on rigid body 100. If user is attaching firearm maintenance tool to a strap, user can place strap between rigid body 100 and locking gate 200 prior to removable connection piece 204 being twisted in a reverse direction 904 until cap 208 is secured within receiving cavity 108. It is anticipated that removable connection piece 204 is manually (i.e., by hand) removable from locking gate 200. However, this does not prevent a user from utilizing additional tools to twist removable connection piece 204 on or off of locking gate 200.

Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of Section 112, sixth paragraph of 35 U.S.C. are not to be invoked unless the specific terms "means for" or "step for" are recited in a claim.

What is claimed is:

1. A firearm maintenance tool comprising:
- a rigid body; and
- a locking gate comprising
  - a pivoting receiver on a first end of the locking gate that pivotally connects the locking gate to the rigid body, and
  - a removable connection piece having a first end that is received by the pivoting receiver and a second end that fixedly secures the locking gate to the rigid body,
- wherein the removable connection piece is completely removable from the rigid body and the pivoting receiver.

2. The firearm maintenance tool of claim 1, the locking gate further comprising a threaded shaft.

3. The firearm maintenance tool of claim 2, wherein the threaded shaft is located at least partially within the pivoting receiver.

4. The firearm maintenance tool of claim 3, wherein the removable connection piece is hollow and is structured and configured to surround the threaded shaft and secure the first end within the pivoting receiver.

5. The firearm maintenance tool of claim 4, wherein an outside, threaded portion of the threaded shaft has a threaded connection with an inside surface of the removable connection piece to enable the removable connection piece to secure inside the pivoting receiver.

6. The firearm maintenance tool of claim 1, wherein the second end of the removable connection piece is structured and configured to fit within a receiving cavity of the rigid body, thereby releasably securing the locking gate to the rigid body and creating an enclosure.

7. The firearm maintenance tool of claim 6, the rigid body comprising a spine, a foot at a first end of the spine, and a hooked head at a second end of the spine, wherein the receiving cavity is at one end of the hooked head.

8. The firearm maintenance tool of claim 7, wherein the enclosure is defined by a space between the foot, the spine, the hooked head, and the locking gate.

9. The firearm maintenance tool of claim 2, wherein the threaded shaft is a takedown punch for removing firearm pins.

10. The firearm maintenance tool of claim 1, wherein the removable connection piece is a front sight adjuster having prongs for maintenance of a front sight of a firearm.

11. The firearm maintenance tool of claim 1, the removable connection piece being structured and configured for manual, tool-free removal from the locking gate.

12. The firearm maintenance tool of claim 1, the removable connection piece comprising a body, a head, and a cap that are substantially colinear.

13. The firearm maintenance tool of claim 12, wherein the body of the removable connection piece connects with the pivoting receiver, the cap of the removable connection piece is structured and configured to be secured within a receiving cavity of the rigid body, and the head of the removable connection piece is sized to prevent the removable connection piece from inserting into the receiving cavity past the cap.

14. The firearm maintenance tool of claim 1, further comprising a plurality of tools contained by the rigid body, wherein at least one of the plurality of tools is pivotally connected on a first end to the rigid body.

15. The firearm maintenance tool of claim 14, wherein the at least one of the plurality of tools is a flat, elongated tool having an aperture through its core that enables a user to grasp the aperture and swivel the flat, elongated tool from a stored position to an activated position extending away from the rigid body.

16. The firearm maintenance tool of claim 14, the rigid body comprising a spine, a foot at a first end of the spine, and a hooked head at a second end of the spine, wherein each of the plurality of tools is pivotally connected to one of the foot or the hooked head.

17. The firearm maintenance tool of claim 16, wherein the hooked head includes a receiving cavity and the second end of the removable connection piece is structured and configured to fit within the receiving cavity, thereby releasably securing the locking gate to the rigid body.

18. A firearm maintenance tool comprising:

a rigid body having a spine, a foot at a first end of the spine, and a hooked head at a second end of the spine;

a locking gate connected to the rigid body and having a pivoting receiver at a first end that is pivotally connected to the foot and a removable connection piece at a second end that is configured to be releasably secured to the hooked head; and a plurality of tools contained by the rigid body, wherein the removable connection piece has a threaded connection with the pivoting receiver to enable a first end of the removable connection piece to be releasably secured to the pivoting receiver, and wherein a cap on a second end of the removable connection piece is structured and configured to be secured within a receiving cavity of the hooked head, and a head of the removable connection piece is substantially colinear with the cap and structured and configured to prevent the removable connection piece from inserting into the receiving cavity past the cap.

19. A method of releasably locking a locking gate to a rigid body, the method comprising:

rotating a pivoting receiver of a locking gate away from a rigid body, the pivoting receiver having a threaded shaft located at least partially within the pivoting receiver;

connecting a removable connection piece of the locking gate to the threaded shaft;

twisting the removable connection piece in a first direction to create a threaded connection between the removable connection piece and the threaded shaft;

rotating the pivoting receiver toward the rigid body so that the removable connection piece is substantially colinear with a receiving cavity of the rigid body; and twisting the removable connection piece in a second, opposite direction to move the removable connection piece toward the receiving cavity, wherein a cap of the removable connection piece inserts into the receiving cavity and further movement into the receiving cavity is prevented by a head of the removable connection piece that is substantially colinear with the cap.

20. The firearm maintenance tool of claim 1, wherein the first end of the removable connection piece is threadedly secured within the pivoting receiver and the second end of the removable connection piece is structured and configured to fit within a receiving cavity of the rigid body, thereby releasably securing the locking gate to the rigid body and creating an enclosure.

* * * * *